US006154979A

United States Patent [19]

Jensen

[11] Patent Number: 6,154,979

[45] Date of Patent: Dec. 5, 2000

[54] METHOD AND APPARATUS FOR THE REMOVAL OF LIQUID FROM PARTICULATE MATERIAL

[75] Inventor: Arne Sloth Jensen, Lyngby, Denmark

[73] Assignee: ASJ Holding ApS, Lyngby, Denmark

[21] Appl. No.: 09/284,088

[22] PCT Filed: Jan. 7, 1999

[86] PCT No.: PCT/DK99/00007

§ 371 Date: Apr. 7, 1999

§ 102(e) Date: Apr. 7, 1999

[87] PCT Pub. No.: WO99/37374

PCT Pub. Date: Jul. 29, 1999

[30] Foreign Application Priority Data

Jan. 9, 1998 [DK] Denmark ..... 1998 00016
May 7, 1998 [DK] Denmark ..... 1998 00623

[51] Int. Cl.[7] ..... F26B 3/08

[52] U.S. Cl. ..... 34/363; 34/364; 34/371; 34/487; 34/167; 34/169; 34/174

[58] Field of Search ..... 34/363, 364, 371, 34/487, 167, 168, 169, 174; 202/99, 100, 108

[56] References Cited

U.S. PATENT DOCUMENTS

| | | | |
|---|---|---|---|
| 3,795,987 | 3/1974 | Kemmetmueler | 34/168 |
| 3,861,058 | 1/1975 | Whelan | 34/57 R |
| 4,026,037 | 5/1977 | Bucholz | 34/212 X |
| 4,069,107 | 1/1978 | Koppelman et al. | 201/12 |
| 4,127,946 | 12/1978 | Bucholz | 34/487 |
| 4,263,260 | 4/1981 | Brautigam | 422/201 |
| 4,813,155 | 3/1989 | Jensen et al. | 34/169 X |
| 5,243,767 | 9/1993 | Stein . | |
| 5,289,643 | 3/1994 | Jensen | 34/169 |
| 5,727,689 | 3/1998 | Anderson et al. | 209/139.1 |

FOREIGN PATENT DOCUMENTS

| | | | |
|---|---|---|---|
| 0 058 651 B1 | 2/1982 | European Pat. Off. | A23K 1/04 |
| 0 153 704 B1 | 2/1985 | European Pat. Off. | F26B 3/10 |
| 195 11961 A1 | 3/1995 | Germany | F26B 3/08 |
| WO 94/06576 | 3/1994 | WIPO | B09B 3/00 |

*Primary Examiner*—Stephen Gravini
*Attorney, Agent, or Firm*—William J. Sapone; Coleman Sudol Sapone, P.C.

[57] ABSTRACT

Method and apparatus for the removal of liquid from particulate material by evaporation through the supply of heat, said heat being transferred substantially by superheated vapours or steam of the liquids existing in the particulate material, and where said method is executed in a substantially closed system. The particulate material is supplied continuously to a process chamber which is configured as an annual or partly annular chamber (1) which lies in a substantially horizontal manner, where the superheated vapours are introduced from below and up through openings (11) in a bottom (10) in the annular chamber, so that the particulate material is brought into movement by the superheated vapours, and such that a transport of the particulate material takes place through the annular chamber (1).

17 Claims, 4 Drawing Sheets

METHOD AND APPARATUS FOR THE REMOVAL OF LIQUID FROM PARTICULATE MATERIAL

Figure 1:
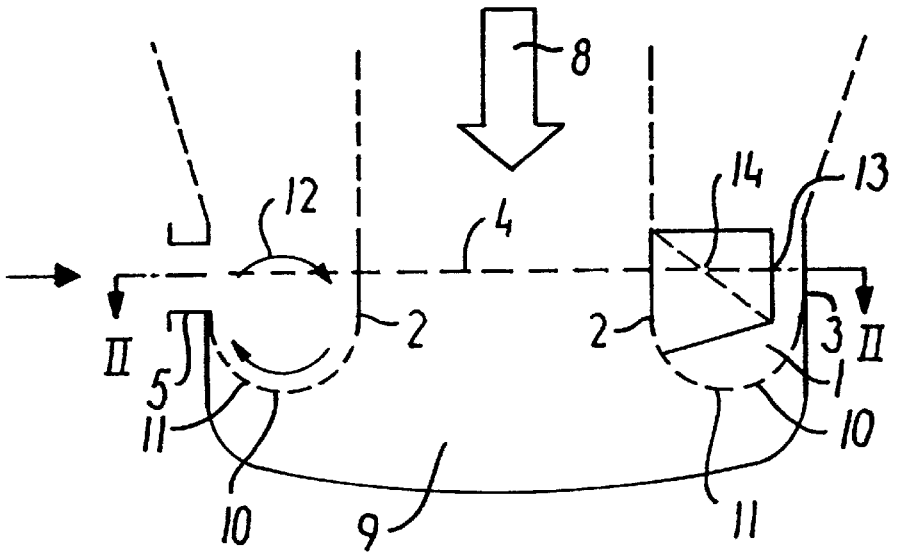

The invention concerns a method for the removal of liquid from particulate material by evaporation through the supply of heat transferred mainly by superheated vapours or steam of the liquids existing in the particulate material, said method taking place in a substantially closed system.

The invention also concerns an apparatus for the execution of such a method, said apparatus consisting of a substantially closed container which has means for the introduction of the particulate material from which liquid is to be removed, means for the removal of dried particulate material, means for the circulation of superheated vapours in the container, means for the supply of thermal energy to these vapours and means for the separation of dust particles from the vapours.

The particulate material can contain particles which can be uniform in size as well as particles which in size can differ considerably from each other. The material can contain several different volatile and liquefied components which are desired to be removed, which is effected in an atmosphere of superheated vapours of the same volatile liquids. If the liquid which is to be removed is water, the process involved is a drying process where the drying takes place in a superheated water vapour. It will be understood, however, that where drying processes are referred to in the following, these could equally well involve similar processes where liquids other than water are removed from the particulate material.

A method and an apparatus of the kind mentioned in the introduction are known, for example from EP Patent Application no. 82 850018.1(publication no. EP 0.058.651 A1). With this known technique, the drying process is effected by the particles to be dried flowing through series-connected vertical pipes or heat exchangers while suspended in the super-heated water vapour. This method gives a uniform retention time which is relatively short, since in practice it is possible to build sufficiently high and sufficiently many vertical pipes and heat exchangers. For example, when the flow rate is 20 m/sec., a retention time of only a few minutes can be achieved with the use of 30 vertical processing zones, each of which is 40 m high. This means that the particles must be of a very uniform particle size and have a very short drying time, which is why this method is suitable only for small, uniform particles, A method and an apparatus are also known from EP 0.153.704, which comprises a series of vertical, rather long processing zones, up through which superheated steam is supplied. Above the processing zones there is a common zone to which particles with reduced moisture content are transferred, in that from here the particles are conveyed further to the removal zone or removal zones. At the lower ends of the processing zones, at least some of the particles can be led through connection channels from one processing zone to the next.

With this known technique, the configuration of the long, vertical processing zone means that a considerable part of the medium-sized particles receive a retention time which is too long. Consequently, they are dried to an undesirably high drystuff content which lowers the product quality, since where many products are concerned the re-absorption of water is hereby reduced. Moreover, the high construction involves relatively high building and installation costs. Finally, by the division of the processing zones there is a relatively great risk that wet, particulate material will block the first zones of the apparatus, partly by adhesion of the product and partly by steam condensing on the product, hereby making it so much heavier that it can no longer be held in movement by the flow of steam.

The object of the invention is to provide a method and an apparatus which avoids the above-mentioned disadvantages in connection with the use of several processing zones, and in that an optimum processing time is achieved for particles of all sizes in the particulate material.

In that use is made only of horizontal chambers, a suitably low configuration of the container is achieved for the execution of the method, and the apparatus is also of a suitably low construction height. With the steam flow and the configuration of the bottom in the annular chamber as disclosed, it is ensured that a circulating or rotating movement is achieved in the substantially vertical plane of the particulate material, so that all parts of the product are held in motion and such that a tight contact is achieved between the product and the superheated vapours.

Figure 2:
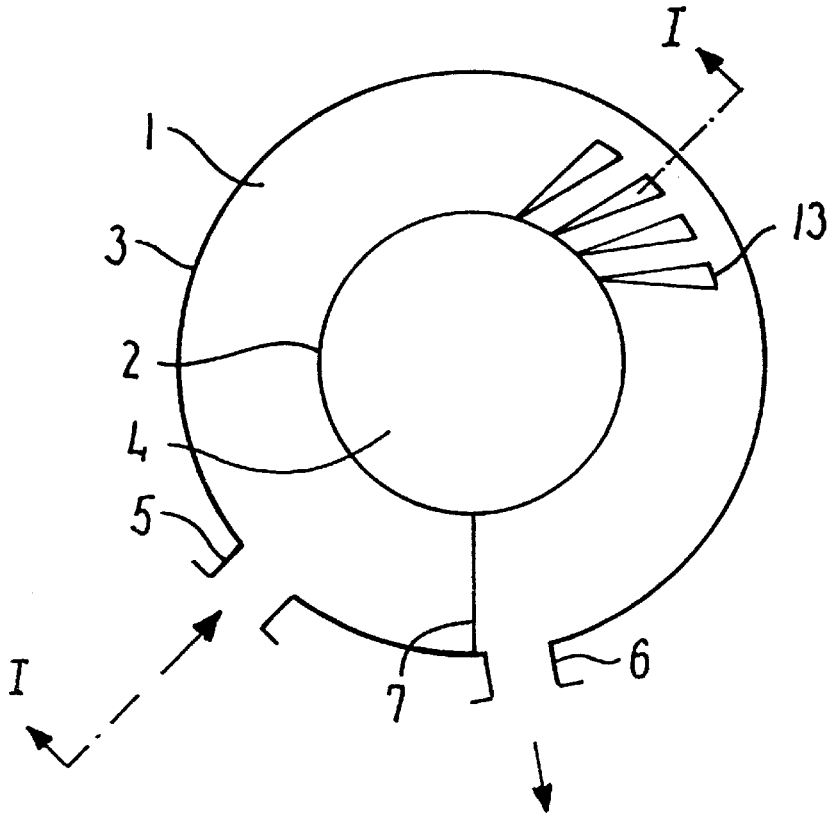
Figure 3:
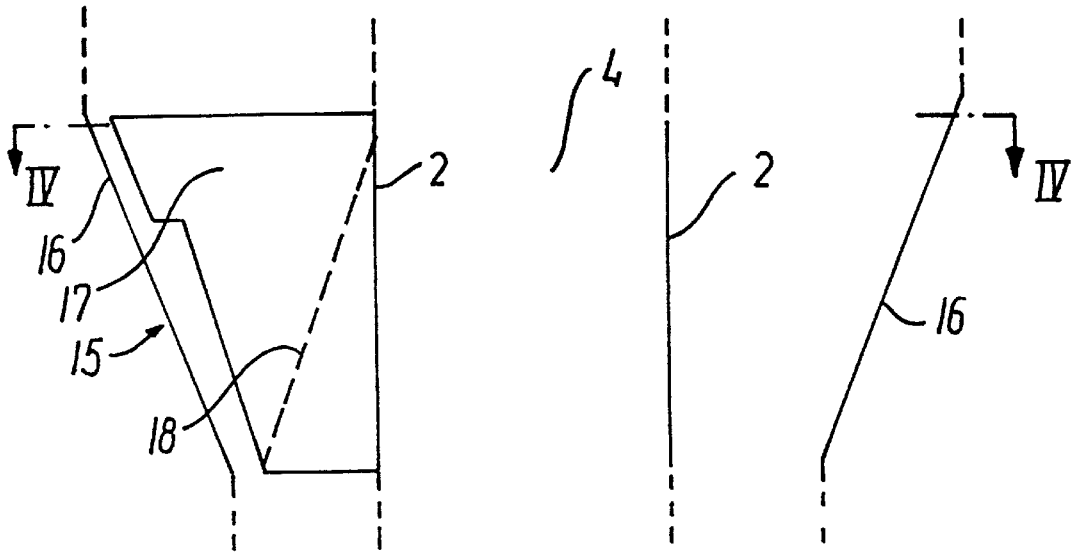
Figure 4:
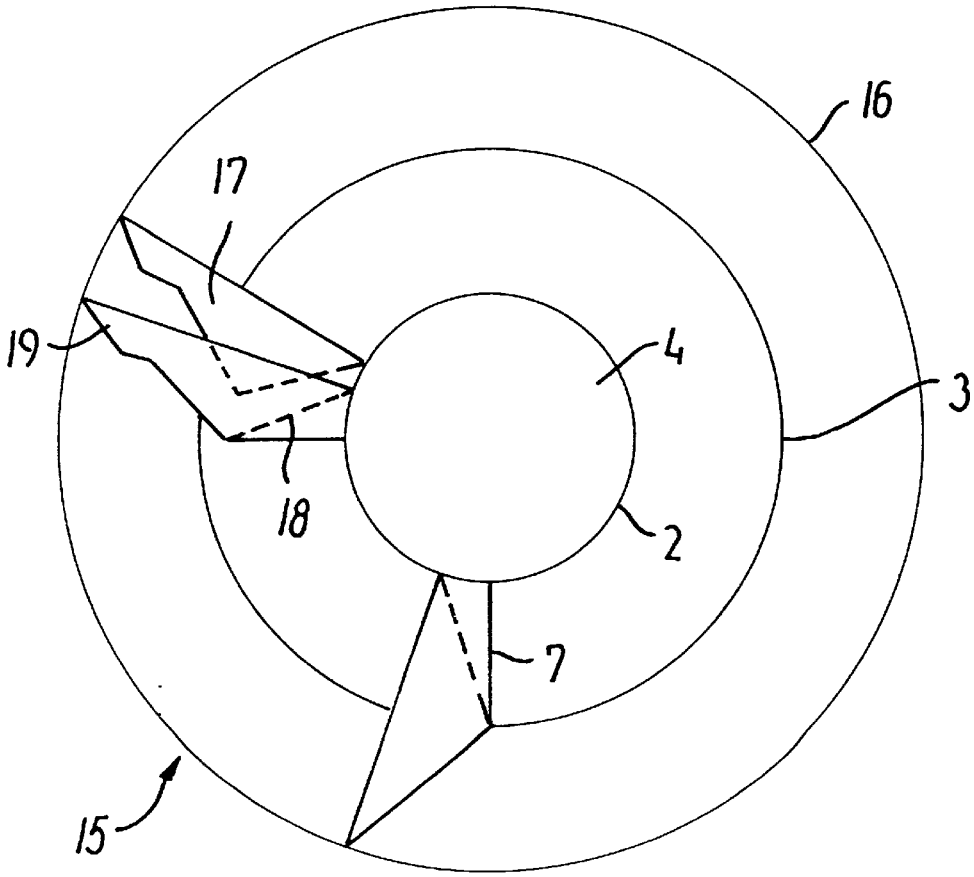
Figure 5:
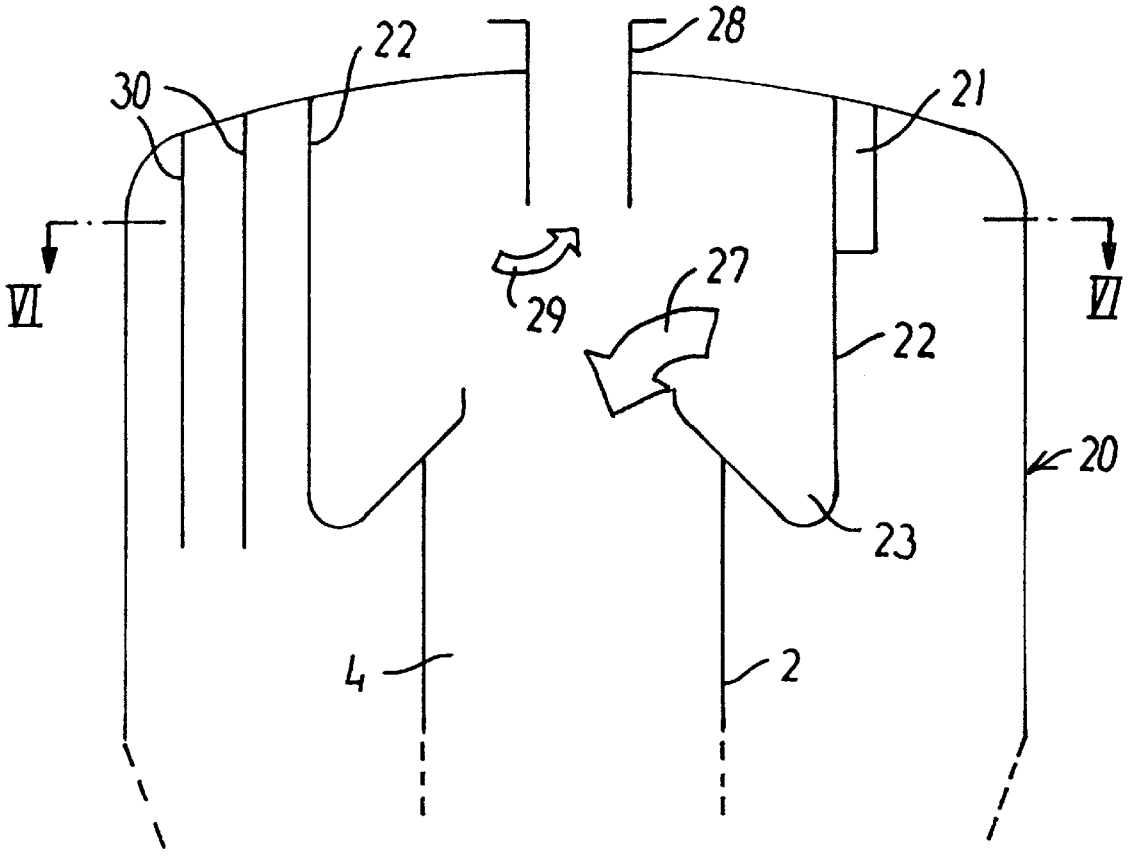
Figure 6:
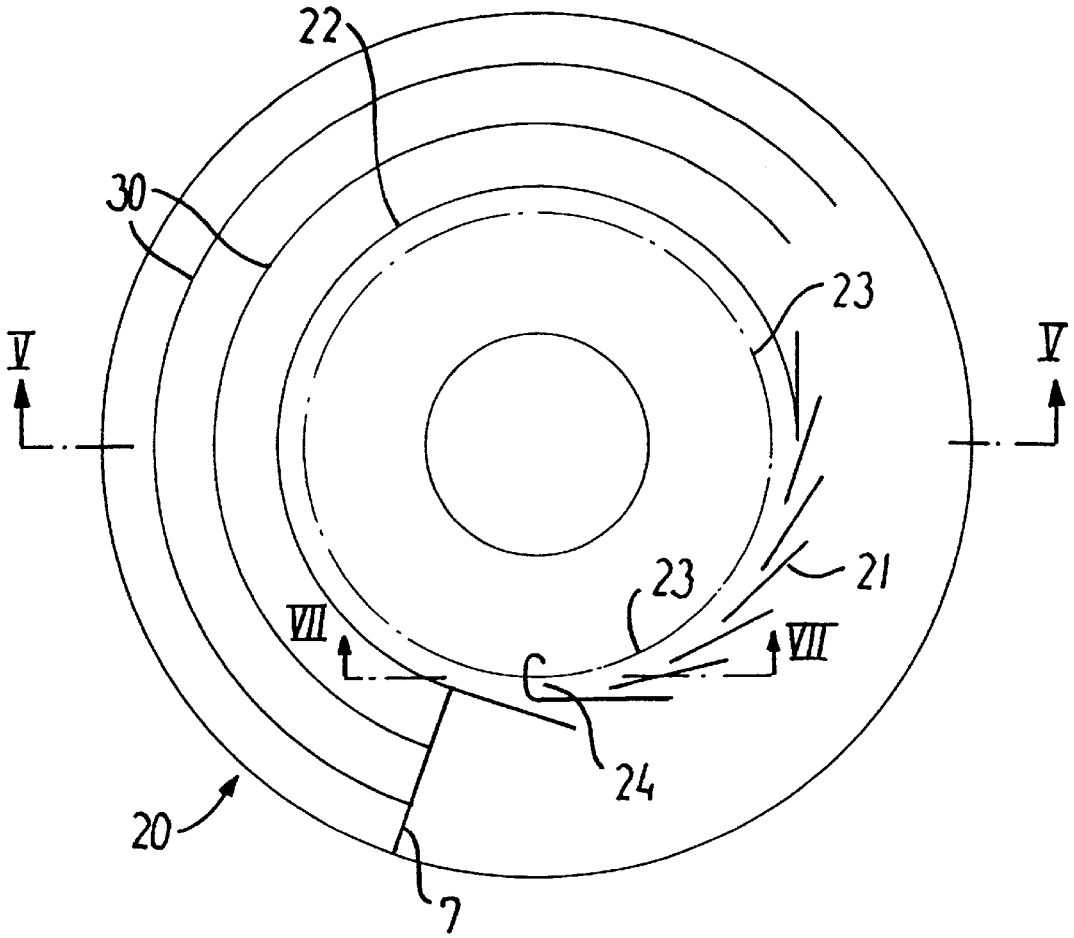
Figure 7:
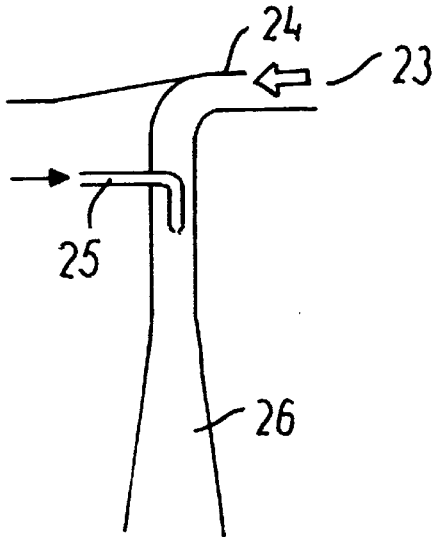

The invention will now be described in more detail with reference to the drawing, where FIG. 1 shows a vertical section of the bottom part for an apparatus according to the invention for the removal of liquids from particulate material, taken along the line I—I in FIG. 2, FIG. 2 shows a vertical section of the bottom part shown in FIG. 1, taken along the line II—II in FIG. 1, FIG. 3 shows a vertical section of a conical transition piece for an apparatus according to the invention, FIG. 4 shows a vertical section of the transition piece shown in FIG. 3, taken along the long IV—IV in FIG. 3, FIG. 5 shows a vertical section of the upper part of an apparatus according to the invention, taken along the line V—V in FIG. 6, FIG. 6 shows a horizontal section of the part shown in FIG. 5, taken along the line VI—VI in FIG. 5, and FIG. 7 shows a vertical section of a discharge opening with associated ejector, taken along the line VII—VII in FIG. 6.

The apparatus according to the invention consists substantially of three parts which are placed on top of one another, i.e. a bottom part 9 as shown in FIGS. 1 and 2, a conical transition piece as shown in FIGS. 3 and 4 and an upper part 20 which is shown in FIGS. 5 and 6.

As will be seen in FIGS. 1 and 2, the bottom part 9 consists of a substantially cylindrical container which has an outer cylindrical surface 3 as outer wall. Inside the bottom part there is a low, annular or partly annular chamber 1 which is open at the top and which is limited at the sides partly by the outer cylindrical surface 3 and partly an inner cylindrical surface 2. At the bottom, the annular chamber 1 is limited by a double-curved bottom 10. This double-curved bottom can have an oval-shaped cross-section or be semi-circular such as shown in FIG. 1, but can also have a cross-section which deviates from an oval or circular shape. The deepest part of the bottom 10 lies in the centremost half-part, and the sides curve upwards towards the inner and outer edges of the chamber, i.e. towards the inner cylindrical surface 2 and the outer cylindrical surface 3. For reasons of production, the bottom can consist of single curves or plane plate pieces which are assembled so that they approximate the round form. Moreover, the double-curved bottom 10 is perforated in that it is provided with a series of openings 11, these opening being described in more detail later.

The bottom part 9 of the apparatus also has a supply pipe 5 for the particulate material which is to be dried, and a discharge pipe 6 for the material which has been dried. The inner cylindrical surface 2 forms a tubular middle chamber 4 which, as shown by the stippled lines, extends up through the remaining parts of the apparatus and which downwardly opens out in a chamber under the annular chamber 1.

Finally, plates 13 are provided in the annular chamber, suspended as illustrated in FIGS. 1 and 2. These plates, the function of which will be described later, can extend from both the inner cylindrical surface 2 (such as shown) and from the outer cylindrical surface 3 (not shown in FIGS. 1 and 2), in that use can be made of one of these forms of positioning alone or a combination of both forms. The suspended plates 13 can be bent forwards or bent along a line 14 as shown.

The function of the bottom part 9 of the apparatus will now be described in more detail. The particulate material to be dried is supplied continuously to the annular chamber 1 through the supply pipe 5 by means of commonly-known but not shown feeding means. At the same time, superheated steam is introduced from above as shown by the arrow 8 and down through the tubular middle chamber 4 to the space under the annular chamber 1, from where the superheated steam flows up into the annular chamber 1 through the openings in the double-curved bottom 10.

The openings 11 in the bottom 10 consist of a combination of openings partly comprising simple holes through which the steam flows at right-angles to the bottom plate, and partly openings which give the steam an influx direction which forms an angle between 0° and 90° with the plate. This angle will preferably lie between 0° and 80°, and in practice the angle will as a rule be limited to an interval between 0° and 30°. Moreover, in terms of percentage, the perforated area in that part of the plate which is closest to the outer periphery is greater than in that part of the plate which is closest to the inner periphery. Together with the influx direction of the steam, this will result in a rotating movement of the particulate product in the substantially vertical plane, such as shown by the arrows 12 in FIG. 1, hereby ensuring the movement of particles of all sizes in the material flow. Moreover, the rotational movement of the particles will also support, e.g. a coating process or an introduction of liquid which is desired to be evaporated together with the particles.

The amount of angle on the angled openings 11 in the bottom 10 can be determined so that the angle depends on where the relevant opening 11 is placed, partly in the radial direction so that a suitable rotating movement is ensured, and partly in the peripheral direction to ensure a movement of the particles around inside the annular chamber 1 from the supply pipe 5 to the discharge pipe 6. The direction in which the superheated steam is blown in can thus be used to increase or reduce the transport forwards in the annular chamber.

In addition, the suspended plates 13 can be used to control the transport. These plates will normally not be radial, but will be arranged to extend in such a direction that the transport forwards in the annular chamber 1 takes place in a suitably fast manner. Moreover, as mentioned earlier these plates can be bent forwards or bent along a line 14 as shown with the object of ensuring the necessary transport speed of the particulate product. Finally, the plates 13 can as mentioned extend from the inner cylindrical surface 2 and/or the outer cylindrical surface 3, in that by a combination of these modes of suspension a kind of labyrinth effect is achieved between the plates.

The energy necessary for evaporation of the liquids from the particles in the flow of material is derived partly from the supply of superheated steam, but a part of it can stem from the suspended plates 13 and the outer walls of the apparatus, which can be heat surfaces. These plates 13 can, for example, be configured of welded-together plates which form a cavity between them to which steam is led at a higher pressure than that which prevails in the annular chamber.

When the particulate product is transported around inside the annular chamber 1, it will finally reach a separator wall 7 which, in the immediate vicinity of the discharge pipe 6, will stop the forwards movement of the product flow in the annular chamber and lead the product out through the discharge pipe 6, from which by commonly-known means not shown the product can be transported further.

As shown in FIG. 2, the supply opening 5 is not placed in the very first part of the annular chamber 1, but in such a manner that there is a certain distance between the separator wall 7 and the supply opening 5. It is hereby achieved that the moist, particulate material which is supplied is immediately mixed with partly dried material from the foremost part of the annular chamber, so that the risk of coatings and adherences with the moist material newly introduced is considerably reduced.

As is commonly used in connection with drying chambers of the fluid-bed type, over the fluid-bed itself, i.e. in this case the annular chamber 1, there is a further chamber with a greater horizontal cross-sectional area. The transition to this area is a conical transition piece 15 which is configured such as shown in FIGS. 3 and 4, where with stippled lines it is also shown how the conical transition piece is connected with the remaining two parts of the apparatus. As will be seen, the outer cylindrical surface 3 extends from the bottom part 9 of the apparatus over into a conical outer wall 16 for the conical transition piece 15, and the inner cylindrical surface 2 continues up from the bottom part through the conical transition piece 15, so that the tubular middle chamber 4 is also to be found again here. The superheated steam which has flowed up through the annular chamber 1, where it has imparted both heat and a rotating movement to the particulate material, will flow further up through the conical transition piece 15 between the inner cylindrical surface 2 and the conical outer wall 16, in that the steam will contain particles which are carried forward by the steam. The speed of the upwardly-flowing steam is so great that a considerable part of the particles will be conveyed up into this piece where these particles will be dried.

The greater part of the particles driven by the steam will be separated by the conical transition piece 15, in that here they are separated by a method which has characteristics in common with laminar-sedimentation. In the conical transition piece 15, between the inner cylindrical surface 2 and the conical outer wall 16, a number of plates 17 are provided which radiate from the inner cylindrical surface 2 out towards the conical outer wall 16. These plates 17, of which only a few are shown in FIG. 4, do not necessarily radiate in a radial manner from the inner cylindrical surface 2. The number of plates 17 which are provided in the conical transition piece 15 is such that the distance between the plates will preferably be between 200 mm and 500 mm. In order to achieve a distance which lies within these limits. pieces of such plates, e.g. half-plates, can be inserted furthest from the centre of the apparatus. The plates 17 are arranged so that they slope forward in the transport direction, and can possibly have one or more bend lines 18 as shown.

The plates 17 do not reach out to the conical outer wall 16. However, there can be places, preferably at the top, where the plates have extensions 19 and reach out to and are supported by the conical outer wall 16. Moreover, the plates 17 can be provided with ribs (not shown) in order to stiffen the relatively large plates. When configured in a suitable manner, these ribs can also contribute towards controlling the flow of steam and the particulate material.

Steam and the particles carried with it will pass up through the plates 17 where a deflection of the flow occurs due to the slope of the plates, and where the speed of the steam is reduced so that particles will fall down on the next underlying plate 17. The particles will slide downwards from the top of this plate to the slot between the plate and the conical outer wall 16, and from the conical outer wall down into the annular chamber 1, from where the particles are again blown up between the plates 17 further forward in the transport direction. In that the steam passes between the plates 17, most of the particles are prevented from reaching out above the conical transition piece 15, and at the same time the particles are transported forward in the apparatus. Only particles of dust will be driven by the steam out over the conical transition piece 15. In the same way as the suspended plates 13, the plates 17 can be heated and like the outer wall 16 can thus serve as heating surfaces.

A separator wall 7 is also provided in the conical transition piece 15, such as shown in FIG. 4. This separator wall 7 prevents the particulate material which has reached to the end of the annular chamber 1, and is thus dried, from being once again blown up by the steam and over into the foremost part of the annular chamber.

The conical transition piece 15 leads up to the uppermost part 20 of the apparatus, which is shown in FIGS. 5 and 6, and in which the final separation of dust takes place. As shown, the upper part 20 is cylindrical, in that the conical outer wall 16 from the conical transition piece 15 (indicated with the stippled lines in FIG. 5) is extended upwards to form an outer wall which is closed at the top. On the inside, the cylindrical surface 2 and herewith the middle chamber 4 are extended for a distance upwards in the uppermost part. In the uppermost part 20, above the middle chamber 4 there is a cylindrical part 22 which over a section of its circumference at the top has an opening with vanes 21, and which at the bottom is associated with the middle chamber 4 by an annular trough 23.

The cylindrical part 22 constitutes a cyclone, in that the upwardly-flowing steam carrying particles of dust will flow into the part 22 between the vanes 21, thus forming a cyclone field. Dust particles will collect on the wall of the cylindrical part 22, sink down along the wall and be rotated around inside the annular trough 23 until they pass through a discharge opening 24 (shown in FIG. 6) in the annular trough 23. As is shown in more detail in FIG. 7, the discharge opening 24 leads to an ejector 25 which sucks dust particles and a part-flow of steam into a vertical outlet cone 26. The ejector 25 is driven by steam from an external supply. The outlet cone 26 is preferably placed above the area where the dry product is removed from the apparatus, i.e. in the area above the discharge pipe 6.

As shown in FIG. 6, the vanes 21 providing inlet to the cylindrical part 22 are preferably placed above the last part of the annular chamber 1, i.e. in that part which is nearest to the area in which the discharge pipe 6 is placed. The result of this is that in the uppermost part 20, outside the cylindrical part 22, a rotating flow arises in the upwardly-rising steam. This rotating flow will pass through the plates 30, which are configured as parts of a cylindrical surface. By its passage through these plates 30, a part of the dust mass carried by the steam will slide down the plates in a boundary layer, so that the amount of dust which is carried forward to the vanes 21 and the cylindrical part 22 will be reduced. The rotational flow will be stopped by a separator wall 7 which is placed such as shown in FIG. 6, after which the flow will be led in between the vanes 21 into the cylindrical part 22.

The flow of steam which has reached into the cylindrical part 22 will pass in the form of a main steam flow down through the middle chamber 4 as shown by the arrow 27. However, in the drying of the particulate material, additional steam is added to the flow, which makes it necessary for a corresponding amount of excess steam to be led away. This takes place though an opening 28 in the top of the uppermost part 20 of the apparatus, such as shown by the arrow 29. This excess steam contains all of the energy which is used for the evaporation. By condensation of the excess steam, this energy can be regained and led back to the process, and the separation of liquid thus takes place with the least possible consumption of energy and without any pollution of the air. Moreover, by controlling the amount of steam led away, the pressure in the closed system can be controlled, in that it can be advantageous to work under a pressure of, e.g. 3 to 4 bar.

When passing down through the middle chamber 4, the main steam flow will also pass a heat exchanger or superheater (not shown), whereby the superheating of the steam is increased so that it assumes new drying potential. In the bottom part 9 of the apparatus there is also a blower, e.g. a centrifugal blower (not shown), which sends the superheated steam up through the annular chamber 1 again.

What is claimed is:

1. A method for removing liquid from particulate by evaporation through the supply of heat transferred from superheated vapor to the liquid in the particulate, comprising:

providing a substantially closed system, continuously supplying the particulate to an at least partly annular chamber lying in a substantially horizontal plane;

leading superheated vapor through openings in a bottom of the at least partly annular chamber, the openings configured for moving the particulate using the superheated vapor;

transporting the particulate using the superheated vapor from an inlet of the substantially horizontal at least partly annular chamber to an outlet therefrom.

2. The method according to claim 1, further comprising providing the bottom of the horizontal at least partly annular chamber with a trough shape, and distributing the openings in the bottom to provide a greater flow of superheated vapor along an outer wall of the at least partly annular chamber.

3. The method according to claim 1, further comprising distributing the openings in the bottom to provide a greater flow of superheated steam adjacent the particulate inlet than adjacent the particulate outlet.

4. The method of claim 1 wherein the bottom has at least an approximate double bent shape.

5. An apparatus for removing liquid from particulate comprising providing a substantially closed container, means for circulating superheated vapor in the container, the container having an at least partially annular chamber lying substantially in a horizontal plane, said chamber having an inlet for introduction of particulate, and an outlet for discharge of dried particulate, and having a bottom, openings provided in the bottom for admitting superheated vapor therethrough, the bottom having a relatively greater open area close to an outer wall of the chamber than to an inner wall of the annular chamber, and a relatively greater open area adjacent the particulate inlet than adjacent the particulate outlet, the openings in the bottom being shaped to effect an influx of vapor partly at a right angle to the bottom and partly at an angle to the bottom of between 0 and 90° so that a rotating movement is imparted to the particulate for transporting the particulate from the particulate inlet to the particulate outlet.

6. The apparatus according to claim 5 wherein the bottom has a its lowest portion which lies within a centermost half of the chamber's breadth between an inner wall and an outer wall of the annular chamber.

7. The apparatus according to claim 5 wherein the bottom has a shape selected from the group consisting of semicircular, oval, or an approximation thereof.

8. The apparatus according to claim 5, further comprising a plurality of plates suspended in the at least partly annular chamber, the plates extending inwardly from the inner wall of the at least partly annular chamber.

9. The apparatus according to claim 5, further comprising a plurality of plates suspended in the at least partially annular chamber, plates extending inwardly from an outer wall of the at least partly annular chamber.

10. The apparatus according to claim 8, wherein the plates have cavities, vapor being supplied to the cavities.

11. The apparatus according to claim 9, wherein the plates have cavities, vapor being supplied to the cavities.

12. The apparatus according to claim 5, further comprising a conical transition piece disposed above the at least partly annular chamber and through which the superheated vapor flows radial, plates located in the conical transition piece which extend radially from an inner wall thereof, the plates curved forward in a direction in which the particulate is transported.

13. The apparatus according to claim 12, wherein the conical transition piece has a conical outer wall, the radial plates having at least a part of an outer edge that extends towards the conical outer wall, the outer edge being spaced from the conical outer wall.

14. The apparatus according to claim 12, wherein the radial plates have cavities, vapor being supplied to the cavities.

15. The apparatus according to claim 5, further comprising a cylindrical part uppermost in the container, the uppermost cylindrical part having a superheated vapor outlet, the cylindrical part being a cyclone separator for separating dust from the superheated vapor before the superheated vapor passes through the superheated vapor outlet.

16. The apparatus according to claim 5 wherein the angle to the bottom is between 0° and 80°.

17. The apparatus according to claim 5 wherein the angle to the bottom is between 0° and 30°.

* * * * *